US008783389B2

(12) United States Patent
Fan et al.

(10) Patent No.: US 8,783,389 B2
(45) Date of Patent: Jul. 22, 2014

(54) POLYCRYSTALLINE DIAMOND CUTTING ELEMENTS WITH ENGINEERED POROSITY AND METHOD FOR MANUFACTURING SUCH CUTTING ELEMENTS

(75) Inventors: Guojiang Fan, Salt Lake City, UT (US); Feng Yu, Lindon, UT (US); Yi Fang, Provo, UT (US); J. Daniel Belnap, Pleasant Grove, UT (US); Peter T. Cariveau, Draper, UT (US)

(73) Assignee: Smith International, Inc., Houston, TX (US)

( * ) Notice: Subject to any disclaimer, the term of this patent is extended or adjusted under 35 U.S.C. 154(b) by 342 days.

(21) Appl. No.: 12/818,780

(22) Filed: Jun. 18, 2010

(65) Prior Publication Data

US 2010/0320006 A1 Dec. 23, 2010

Related U.S. Application Data

(60) Provisional application No. 61/218,382, filed on Jun. 18, 2009.

(51) Int. Cl.
*E21B 10/36* (2006.01)
*E21B 10/567* (2006.01)

(52) U.S. Cl.
CPC ..... *E21B 10/36* (2013.01); *E21B 10/567* (2013.01)
USPC ..... 175/433; 175/434

(58) Field of Classification Search
CPC ..... E21B 10/46; E21B 10/567
USPC ..... 175/420.2, 433, 434, 405.1; 51/296
See application file for complete search history.

(56) References Cited

U.S. PATENT DOCUMENTS

| | | | |
|---|---|---|---|
| 2,941,241 | A | 6/1960 | Strong |
| 2,941,248 | A | 6/1960 | Hall |
| 2,947,611 | A | 8/1960 | Bundy |
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,609,818 | A | 10/1971 | Wentorf, Jr. |
| 3,745,623 | A | 7/1973 | Wentorf, Jr. et al. |
| 3,767,371 | A | 10/1973 | Wentorf, Jr. et al. |
| 4,104,344 | A | 8/1978 | Pope et al. |

(Continued)

FOREIGN PATENT DOCUMENTS

| | | |
|---|---|---|
| EP | 0 196 777 B1 | 10/1986 |
| EP | 0 300 699 A2 | 1/1989 |

(Continued)

OTHER PUBLICATIONS

The International Search Report and the Written Opinion of the International Searching Authority dated Jan. 26, 2011, for International Application No. PCT/US2010/039184, Filed Jun. 18, 2010; 6 pages.

*Primary Examiner* — Cathleen Hutchins
(74) *Attorney, Agent, or Firm* — Christie, Parker & Hale, LLP

(57) ABSTRACT

A method for facilitating infiltration of an infiltrant material into a TSP material during re-bonding of the TSP material to a substrate, by enhancing the porosity of the TSP material near the interface with the substrate is provided. Cutting elements formed by such method and downhole tools including such cutting elements are also provided.

34 Claims, 3 Drawing Sheets

(56) References Cited

U.S. PATENT DOCUMENTS 4,108,614 A 8/1978 Mitchell
4,151,686 A 5/1979 Lee et al.
4,224,380 A 9/1980 Bovenkerk et al.
4,255,165 A 3/1981 Dennis et al.
4,268,276 A 5/1981 Bovenkerk
4,288,248 A 9/1981 Bovenkerk et al.
4,289,503 A 9/1981 Corrigan
4,303,442 A 12/1981 Hara et al.
4,311,490 A 1/1982 Bovenkerk et al.
4,373,593 A 2/1983 Phaal et al.
4,387,287 A 6/1983 Marazzi
4,403,015 A 9/1983 Nakai et al.
4,412,980 A 11/1983 Tsuji et al.
4,481,016 A 11/1984 Campbell et al.
4,486,286 A 12/1984 Lewin et al.
4,504,519 A 3/1985 Zelez
4,505,746 A 3/1985 Nakai et al.
4,522,633 A 6/1985 Dyer
4,525,178 A 6/1985 Hall
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A * 8/1986 Hall ..... 51/293
4,605,343 A 8/1986 Hibbs, Jr. et al.
4,606,738 A 8/1986 Hayden
4,621,031 A 11/1986 Scruggs
4,629,373 A 12/1986 Hall
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,673,414 A 6/1987 Lavens et al.
4,694,918 A 9/1987 Hall
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,850,523 A 7/1989 Slutz
4,861,350 A 8/1989 Phaal et al.
4,871,377 A 10/1989 Frushour
4,882,128 A 11/1989 Hukvari et al.
4,899,922 A 2/1990 Slutz et al.
4,919,220 A 4/1990 Fuller et al.
4,931,068 A 6/1990 Dismukes et al.
4,933,529 A 6/1990 Saville
4,940,180 A 7/1990 Martell
4,943,488 A 7/1990 Sung et al.
4,944,772 A 7/1990 Cho
4,954,139 A 9/1990 Cerutti
4,976,324 A 12/1990 Tibbitts
4,984,642 A 1/1991 Renard et al.
4,987,800 A 1/1991 Gasan et al.
5,011,514 A 4/1991 Cho et al.
5,011,515 A 4/1991 Frushour
5,027,912 A 7/1991 Juergens
5,030,276 A 7/1991 Sung et al.
5,032,147 A 7/1991 Frushour
5,068,148 A 11/1991 Nakahara et al.
5,092,687 A 3/1992 Hall
5,096,465 A 3/1992 Chen et al.
5,116,568 A 5/1992 Sung et al.
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenström et al.
5,337,844 A 8/1994 Tibbitts
5,355,696 A 10/1994 Briggs
5,369,034 A 11/1994 Hargett et al.
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,494,477 A 2/1996 Flood et al.
5,496,638 A 3/1996 Waldenström et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,564,511 A 10/1996 Frushour
5,605,198 A 2/1997 Tibbitts et al.
5,607,024 A 3/1997 Keith et al.
5,620,382 A 4/1997 Cho et al.
5,624,068 A 4/1997 Waldenström et al.
5,645,617 A 7/1997 Frushour
5,667,028 A 9/1997 Truax et al.
5,718,948 A 2/1998 Ederyd et al.
5,722,497 A 3/1998 Gum et al.
5,722,499 A 3/1998 Nguyen et al.
5,776,615 A 7/1998 Wong et al.
5,820,985 A 10/1998 Chow et al.
5,833,021 A 11/1998 Mensa-Wilmot et al.
5,853,873 A 12/1998 Kukino et al.
5,862,873 A * 1/1999 Matthias et al. ..... 175/432
5,875,862 A 3/1999 Jurewicz et al.
5,887,580 A 3/1999 Eyre
5,889,219 A 3/1999 Moriguchi et al.
5,897,942 A 4/1999 Karner et al.
5,954,147 A 9/1999 Overstreet et al.
5,979,578 A 11/1999 Packer
6,009,963 A 1/2000 Chaves et al.
6,041,875 A 3/2000 Rai et al.
6,054,693 A 4/2000 Barmatz et al.
6,063,333 A 5/2000 Dennis
6,123,612 A 9/2000 Goers
6,126,741 A 10/2000 Jones et al.
6,131,678 A 10/2000 Griffin
6,132,675 A 10/2000 Corrigan et al.
6,165,616 A 12/2000 Lemelson et al.
6,193,001 B1 2/2001 Eyre et al.
6,196,341 B1 3/2001 Chaves
6,202,770 B1 3/2001 Jurewicz et al.
6,216,805 B1 4/2001 Lays et al.
6,220,375 B1 4/2001 Butcher et al.
6,234,261 B1 5/2001 Evans et al.
6,248,447 B1 6/2001 Griffin et al.
6,258,139 B1 7/2001 Jensen
6,269,894 B1 8/2001 Griffin
6,298,930 B1 10/2001 Sinor et al.
6,302,225 B1 10/2001 Yoshida et al.
6,315,065 B1 11/2001 Yong et al.
6,344,149 B1 2/2002 Oles
6,410,085 B1 6/2002 Griffin et al.
6,435,058 B1 8/2002 Matthias et al.
6,443,248 B2 9/2002 Yong et al.
6,447,560 B2 9/2002 Jensen et al.
6,544,308 B2 4/2003 Griffin et al.
6,550,556 B2 4/2003 Middlemiss et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,605,798 B1 8/2003 Cullen
6,739,214 B2 5/2004 Griffin et al.
6,749,033 B2 6/2004 Griffin et al.

(56) References Cited

U.S. PATENT DOCUMENTS

| | | | |
|---|---|---|---|
| 6,797,326 | B2 | 9/2004 | Griffin et al. |
| 6,892,836 | B1 | 5/2005 | Eyre et al. |
| 7,108,598 | B1 | 9/2006 | Galloway |
| 7,316,279 | B2 | 1/2008 | Wiseman et al. |
| 7,350,601 | B2 | 4/2008 | Belnap et al. |
| 7,377,341 | B2 | 5/2008 | Middlemiss et al. |
| 7,517,589 | B2 | 4/2009 | Eyre |
| 7,568,770 | B2 | 8/2009 | Hall et al. |
| 2002/0034631 | A1 | 3/2002 | Griffin et al. |
| 2002/0034632 | A1 | 3/2002 | Griffin et al. |
| 2002/0045059 | A1 | 4/2002 | Griffin et al. |
| 2002/0071729 | A1 | 6/2002 | Middlemiss et al. |
| 2002/0084112 | A1 | 7/2002 | Hall et al. |
| 2003/0235691 | A1 | 12/2003 | Griffin et al. |
| 2004/0094333 | A1 | 5/2004 | Yamamoto et al. |
| 2005/0050801 | A1 | 3/2005 | Cho et al. |
| 2005/0129950 | A1 | 6/2005 | Griffin et al. |
| 2005/0133277 | A1 | 6/2005 | Dixon |
| 2005/0210755 | A1 | 9/2005 | Cho et al. |
| 2005/0230156 | A1 | 10/2005 | Belnap et al. |
| 2005/0263328 | A1 | 12/2005 | Middlemiss |
| 2006/0060390 | A1 | 3/2006 | Eyre |
| 2006/0060392 | A1 | 3/2006 | Eyre |
| 2006/0157285 | A1 | 7/2006 | Cannon et al. |
| 2006/0165993 | A1 | 7/2006 | Keshavan |
| 2006/0191723 | A1 | 8/2006 | Keshavan |
| 2006/0207802 | A1 | 9/2006 | Zhang et al. |
| 2006/0247769 | A1 | 11/2006 | Molz et al. |
| 2006/0266558 | A1 | 11/2006 | Middlemiss et al. |
| 2006/0266559 | A1 | 11/2006 | Keshavan et al. |
| 2007/0029114 | A1 | 2/2007 | Middlemiss |
| 2007/0079994 | A1 | 4/2007 | Middlemiss |
| 2007/0169419 | A1 | 7/2007 | Davis et al. |
| 2007/0181348 | A1 | 8/2007 | Lancaster et al. |
| 2008/0085407 | A1 | 4/2008 | Cooley et al. |
| 2008/0115421 | A1 | 5/2008 | Sani |
| 2008/0142276 | A1 | 6/2008 | Griffo et al. |
| 2008/0178535 | A1 | 7/2008 | Wan |
| 2008/0185189 | A1 | 8/2008 | Griffo et al. |
| 2008/0206576 | A1 | 8/2008 | Qian et al. |
| 2008/0223621 | A1 | 9/2008 | Middlemiss et al. |
| 2008/0223623 | A1 | 9/2008 | Keshavan et al. |
| 2008/0230280 | A1 | 9/2008 | Keshavan et al. |
| 2008/0240879 | A1 | 10/2008 | Dourfaye et al. |
| 2009/0032169 | A1 | 2/2009 | Dourfaye et al. |
| 2009/0090563 | A1 | 4/2009 | Voronin et al. |
| 2009/0152017 | A1 | 6/2009 | Shen et al. |
| 2009/0152018 | A1 | 6/2009 | Sani |
| 2011/0023375 | A1 | 2/2011 | Sani et al. |
| 2012/0222364 | A1 | 9/2012 | Lyons et al. |
| 2012/0225277 | A1 | 9/2012 | Scott |

FOREIGN PATENT DOCUMENTS

| | | | |
|---|---|---|---|
| EP | 0 329 954 | A2 | 8/1989 |
| EP | 0 352 811 | A1 | 1/1990 |
| EP | 0 500 253 | A1 | 8/1992 |
| EP | 0 595 630 | A1 | 5/1994 |
| EP | 0 612 868 | A1 | 8/1994 |
| EP | 0 617 207 | A2 | 9/1994 |
| EP | 0 787 820 | A2 | 8/1997 |
| EP | 0 860 515 | A1 | 8/1998 |
| EP | 1 116 858 | A1 | 7/2001 |
| EP | 1 190 791 | A2 | 3/2002 |
| EP | 1 958 688 | A1 | 8/2008 |
| GB | 1 349 385 | A | 4/1974 |
| GB | 2 048 927 | A | 12/1980 |
| GB | 2 261 894 | A | 6/1993 |
| GB | 2 268 768 | A | 1/1994 |
| GB | 2 270 492 | A | 3/1994 |
| GB | 2 270 493 | A | 3/1994 |
| GB | 2 323 398 | A | 9/1998 |
| GB | 2 351 747 | A | 1/2001 |
| GB | 2 367 081 | A | 3/2002 |
| GB | 2 408 735 | A | 6/2005 |
| GB | 2 413 575 | A | 11/2005 |
| GB | 2 418 215 | A | 3/2006 |
| GB | 2 422 623 | A | 8/2006 |
| GB | 2 427 215 | A | 12/2006 |
| GB | 2 429 471 | A | 2/2007 |
| GB | 2 429 727 | A | 3/2007 |
| GB | 2 438 073 | A | 11/2007 |
| GB | 2 447 776 | A | 9/2008 |
| JP | 59-219500 | | 12/1984 |
| JP | 60-187603 | | 9/1985 |
| JP | 2003-291036 | A | 10/2003 |
| WO | WO 93/23204 | | 11/1993 |
| WO | WO 96/34131 | | 10/1996 |
| WO | WO 00/28106 | | 5/2000 |
| WO | WO 2004/040095 | A1 | 5/2004 |
| WO | WO 2004/106003 | A1 | 12/2004 |
| WO | WO 2004/106004 | A1 | 12/2004 |
| WO | WO 2007/042920 | A1 | 4/2007 |
| WO | WO 2010/098978 | A1 | 9/2010 |

* cited by examiner

POLYCRYSTALLINE DIAMOND CUTTING ELEMENTS WITH ENGINEERED POROSITY AND METHOD FOR MANUFACTURING SUCH CUTTING ELEMENTS

CROSS-REFERENCE TO RELATED APPLICATION

This application is based upon and claims priority on U.S. Provisional Application No. 61/218,382, filed on Jun. 18, 2009, the contents of which are fully incorporated herein by reference.

BACKGROUND OF THE INVENTION

Cutting elements, such as shear cutter type cutting elements used in rock bits or other cutting tools, typically have a body (i.e., a substrate) and an ultra hard material. The ultra hard material forms the cutting surface of the cutting element, and the substrate typically attaches the ultra hard material to the cutting tool. The substrate is generally made from tungsten carbide-cobalt (sometimes referred to simply as "cemented tungsten carbide," "tungsten carbide" or "caarbide"). The ultra hard material layer is a polycrystalline ultra hard material, such as polycrystalline diamond ("PCD"), polycrystalline cubic boron nitride ("PCBN") or thermally stable product ("TSP") such as thermally stable polycrystalline diamond. The ultra hard material provides a high level of wear and/or abrasion resistance that is greater than that of the metallic substrate.

PCD is formed by a known process in which diamond crystals are mixed with a catalyst material and sintered at high pressure and high temperature. The catalyst material may be mixed into the diamond powder prior to sintering and/or may infiltrate the diamond powder from an adjacent substrate during sintering. The high pressure high temperature sintering process ("HPHT sintering") creates a polycrystalline diamond structure having a network of intercrystalline bonded diamond crystals, with the catalyst material remaining in the voids or gaps between the bonded diamond crystals.

The catalyst material facilitates and promotes the intercrystalline bonding of the diamond crystals. The catalyst material is typically a solvent catalyst metal from Group VIII of the Periodic table, such as cobalt, iron, or nickel. However, the presence of the catalyst material in the sintered PCD material introduces thermal stresses to the PCD material when the PCD material is heated, for example by frictional heating during use, as the catalyst typically has a higher coefficient of thermal expansion than does the PCD material. Thus, the sintered PCD is subject to thermal stresses, which limit the service life of the cutting element.

To address this problem, the catalyst is substantially removed from the PCD material, such as by leaching, in order to create TSP. For example, one known approach is to remove a substantial portion of the catalyst material from at least a portion of the sintered PCD by subjecting the sintered PCD construction to a leaching process, which forms a TSP material portion substantially free of the catalyst material. If a substrate was used during the HPHT sintering, it is typically removed prior to leaching.

After the TSP material has been formed, it can be bonded onto a new substrate in order to form a cutting element. During this process, called the "re-bonding process," the TSP material and substrate are subjected to heat and pressure. An infiltrant material (such as cobalt from the substrate) infiltrates the TSP material, moving into the pores (i.e., the voids or interstitial spaces) (collectively or individually referred to herein as "pores") between the bonded crystals, previously occupied by the catalyst material. The infiltration of this infiltrant material from the substrate into the TSP layer creates a bond between the TSP layer and the substrate. The re-bonded TSP layer may be partially re-leached to improve the thermal stability, such as at the working surface of the TSP layer.

Existing TSP cutting elements are known to fail prematurely due to insufficient infiltration of the infiltrant material into the TSP layer during the re-bonding process, leading to residual porosity in the re-bonded TSP layer. As explained above, when the PCD material is leached to form TSP, the catalyst material in the PCD layer is removed from the pores between the diamond crystals. If these pores are only partially infiltrated or not properly infiltrated during the re-bonding process, the empty pores can weaken the bond and create structural flaws. This partial infiltration makes the TSP cutters vulnerable to cracking during finishing operations such as lapping and grinding. Partial infiltration also makes re-leaching more difficult, and weakens the bond between the TSP layer and the substrate. Accordingly, there is a need for a method for forming TSP material that facilitates infiltration during re-bonding, and improves the thermal characteristics and operating life of the material.

SUMMARY OF THE INVENTION

In an exemplary embodiment, there is provided a method for facilitating infiltration of an infiltrant material into a TSP material during re-bonding of the TSP material to a substrate, by enhancing the porosity of the TSP material near the interface with the substrate. In one embodiment, the method includes mixing a filler material or additive with a diamond powder mixture prior to HPHT sintering, and then HPHT sintering the diamond powder and filler material mixture to form polycrystalline diamond (PCD). The filler material occupies space in the sintered PCD layer, residing between the bonded diamond crystals. After HPHT sintering, this filler material is removed, such as by leaching, to form a thermally stable product (TSP) with pores between the bonded diamond crystals. The amount and distribution of filler material in the diamond powder is controlled to provide a greater porosity in at least a portion of the TSP layer, which enables the infiltrant material to more fully infiltrate the TSP during re-bonding. The result is a re-bonded TSP cutting element with more complete infiltration, leading to a better bond between the TSP layer and the substrate and a longer operating life than TSP created through prior methods.

In one embodiment, a method of forming a re-infiltrated thermally stable polycrystalline diamond cutting element includes mixing diamond particles and a filler material to create a diamond powder mixture. The diamond powder mixture comprises a first portion with at least 4% filler material by weight, and a second portion with less filler material than the first portion. The first portion is at least 25% of the volume of the diamond powder mixture. The method also includes sintering the diamond powder mixture at high temperature and high pressure to form a polycrystalline diamond material, removing the filler material from the polycrystalline diamond material to form a thermally stable polycrystalline diamond material having an enhanced porosity in the first portion, and bonding the thermally stable material to a substrate. Bonding comprises infiltrating the first portion with an infiltrant material from the substrate. In one exemplary embodiment the second portion includes a depression and the first portion includes a projection received in the depression.

In another embodiment, a cutting element includes a substrate and a thermally stable polycrystalline diamond body bonded to the substrate. The thermally stable polycrystalline diamond body comprises a working surface; a material microstructure comprising a plurality of bonded-together diamond crystals and pores between the diamond crystals, the pores being substantially free of a catalyst material; a first portion of the material microstructure proximate the substrate; and a second portion of the material microstructure proximate the working surface. The first portion comprises an infiltrant material in the pores between the diamond crystals. The first portion includes a first porosity and the second portion comprises a second porosity, the difference in porosity being at least 1.6% when such porosities are measured without the infiltrant. In an exemplary embodiment, the second portion includes a depression and the first portion includes a projection received in the depression.

In another exemplary embodiment a cutting element is provided including a substrate, and a thermally stable polycrystalline diamond body bonded to the substrate. The thermally stable polycrystalline diamond body includes a working surface opposite the substrate, a material microstructure comprising a plurality of bonded-together diamond crystals, and pores between the diamond crystals, the pores being substantially free of a catalyst material. The thermally stable polycrystalline diamond body also includes a first portion of the material microstructure proximate the substrate and including a projection, and a second portion of the material microstructure proximate the working surface and including a depression receiving the projection. The first portion includes an infiltrant material in one or more of the pores between the diamond crystals. The material microstructure has a differential porosity between the first and second portions when such porosities are measured without the infiltrant. In one exemplary embodiment, the depression is complementary to said projection. In another exemplary embodiment, the projection is domed shaped. In a further exemplary embodiment, the first portion has a greater porosity than the second portion. In yet another exemplary embodiment, the material microstructure has a differential porosity of at least 1.6% between the first and second portions.

In yet a further exemplary embodiment, a downhole tool is provided including a tool body and at least one of the aforementioned exemplary embodiment cutting elements. In one exemplary embodiment, the downhole tool is a drill bit, as for example as drag bit.

DETAILED DESCRIPTION OF THE INVENTION

In an exemplary embodiment, there is provided a method for facilitating infiltration of an infiltrant material into a TSP material during re-bonding of the TSP material to a substrate, by enhancing the porosity of the TSP material near the interface with the substrate. In one embodiment, the method includes mixing a filler material or additive (collectively or individually referred to herein as "filler material") with a diamond powder mixture prior to HPHT sintering, and then HPHT sintering the diamond powder and filler material mixture to form polycrystalline diamond (PCD). The filler material occupies space in the sintered PCD layer, residing between the bonded diamond crystals. After HPHT sintering, this filler material is removed, such as by leaching, to form a thermally stable product (TSP) with pores between the bonded diamond crystals. The amount and distribution of filler material in the diamond powder is controlled to provide a greater porosity in at least a portion of the TSP layer, which enables the infiltrant material to more fully infiltrate the TSP during re-bonding. The pores provide a pathway for the infiltrant material during the re-bonding process and facilitate movement of the infiltrant from the substrate into the TSP layer. The result is a re-bonded TSP cutting element with more complete infiltration, leading to a better bond between the TSP layer and the substrate and a longer operating life than TSP created through prior methods. Thus, including a filler material or additive in the diamond powder mixture prior to HPHT sintering enables the porosity of the TSP layer to be controlled.

Figure 1:
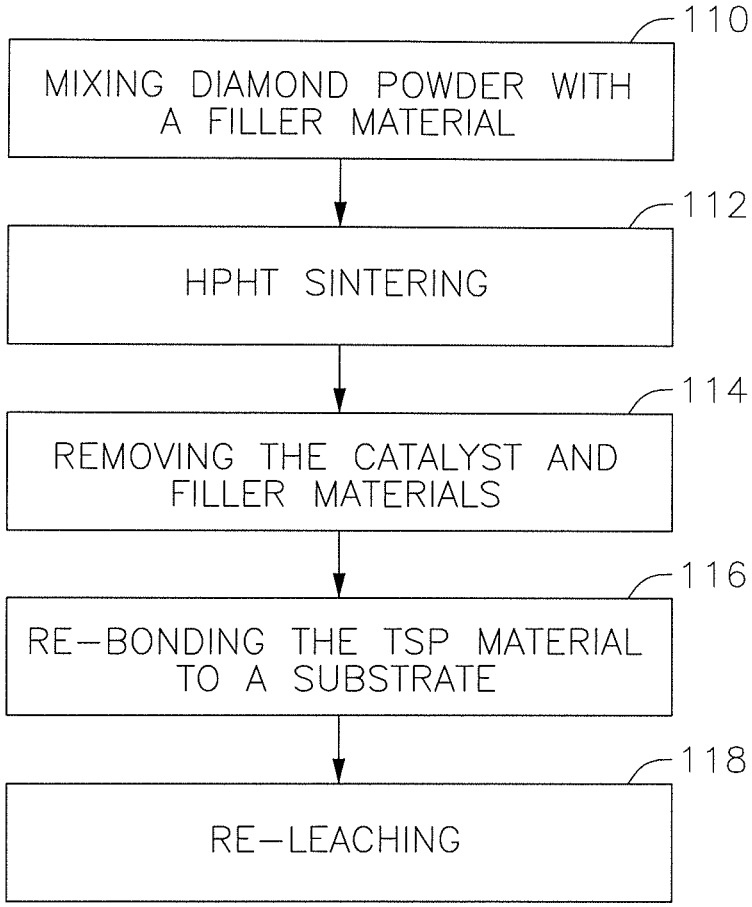
FIG. 1 is a flowchart of a method of forming a re-infiltrated TSP cutting element according to an embodiment of the present disclosure.

A method of forming a re-infiltrated TSP cutting element according to an exemplary embodiment of the present disclosure is shown in FIG. 1. The method includes mixing a diamond powder mixture with a filler material or additive 110. The diamond powder mixture is a blend of diamond crystals of the desired grain sizes. The mixture may include diamond crystals of a uniform grain size, or a blend of multiple grain sizes. The diamond crystals are typically provided in powder form and mixed together to create the desired distribution of grain sizes in the diamond layer. The diamond can be natural and/or synthetic. Exemplary diamond crystal sizes are in the range of about 1-40 microns. Optionally, a catalyst material such as a metal from Group VIII of the Periodic table, such as cobalt, may also be added to this mixture to promote intercrystalline bonding during HPHT sintering. Alternatively or in addition, the catalyst material may infiltrate the diamond layer from an adjacent substrate during HPHT sintering. For example, cobalt from a tungsten carbide substrate may move into the diamond layer during HPHT sintering.

The diamond, catalyst, and filler materials are mixed together to create a desired distribution of filler material throughout the diamond layer. For example, a greater amount of filler material may be provided in the region of the diamond layer nearest the substrate, in order to increase the porosity in this region after leaching (as described in more detail below). Mixing may be accomplished by ball milling, mechanical mixing, or other known methods.

After the diamond and filler materials are mixed together in the desired distribution, the method then includes placing the diamond mixture inside a refractory metal enclosure such as a niobium can for sintering. The method includes sintering these materials at high pressure and high temperature ("HPHT sintering" or "HTHP sintering") 112. The high pressure may be 5,000 MPa or greater (hot cell pressure), and the high temperature may be about 1,300° C. to 1,500° C. or higher. The high pressure as measured by the hydraulic fluid pressure of the press may be about 10.7 ksi. In one embodiment, the diamond mixture is placed adjacent a substrate such as a tungsten carbide substrate, and the diamond mixture and substrate are HPHT sintered. In another embodiment, the diamond mixture is HPHT sintered without a substrate.

When a substrate is present, catalyst material from the substrate, such as cobalt, moves into the spaces between the diamond crystals during HPHT sintering. The catalyst material encourages the growth and bonding of crystals during the HPHT sintering to form a polycrystalline diamond structure. As used herein, the term "catalyst material" refers to the material that is initially used to facilitate diamond-to-diamond bonding or sintering during the initial HPHT process used to form the PCD. In one embodiment, the filler material is an additional amount of the catalyst, so that the total amount of this material mixed with the diamond acts as both a catalyst to form the PCD and as a filler to eventually increase the porosity of the TSP material.

Figure 2:
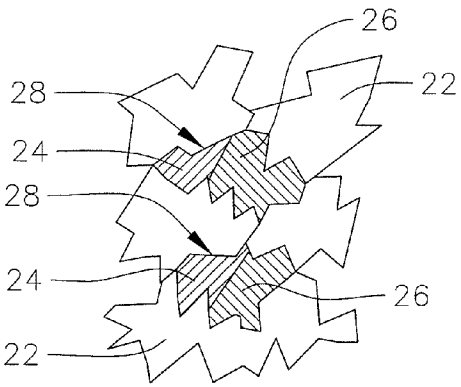
FIG. 2 is a representation of pores in a polycrystalline diamond material according to an embodiment of the present disclosure.

The HPHT sintering 112 creates a polycrystalline structure as shown in FIG. 2, in which the diamond crystals 22 are bonded together, with the catalyst material 24 and filler material 26 remaining dispersed within the pores 28 between the diamond crystals 22. Referring again to FIG. 1, the method then includes removing (such as by leaching) the catalyst material and filler material from the PCD 114 to form a TSP material. Notably, if a substrate is used during the HPHT sintering, then it is removed from the PCD layer prior to leaching. The leaching can be accomplished by subjecting the PCD material to a leaching agent (such as an acid wash) over a particular period of time or by other known leaching methods such as electrolytic process, liquid metal solubility, etc. In an embodiment, substantially all of the catalyst and filler materials are removed from the PCD layer, although trace or residual amounts may remain. In one embodiment the PCD layer is leached to a depth of approximately 2500 microns from the working surface of the PCD layer.

In one embodiment, the leaching conditions include contacting a region of the PCD body with a sufficient volume of an acid mixture at a temperature of 40° C.±2° C. under atmospheric pressure. The acid mixture is 50% v of a first acid solution and 50% v of a second acid solution. The first acid solution is 5.3 mol/liter $HNO_3$ (reagent grade nitric acid). The second acid solution is 9.6 mol/liter HF (reagent grade hydrofluoric acid). In one or more embodiments, accelerating techniques for removing the catalyst material and the filler material may also be used, and may be used in conjunction with the leaching techniques noted herein as well as with other conventional leaching processes. Such accelerating techniques include elevated pressures, elevated temperatures and/or ultrasonic energy, and may be useful to decrease the amount of treatment time associated with achieving the same level of catalyst and filler removal, thereby improving manufacturing efficiency. In one embodiment, the leaching process may be accelerated by conducting the same leaching process described above under conditions of elevated pressure that may be greater than about 5 bar, and that may range from about 10 to 50 bar in other embodiments. Such elevated pressure conditions may be achieved by conducting the leaching process in a pressure vessel or the like.

For example in one embodiment, leaching is achieved by placing the PCD sample in an acid solution in a Teflon container, which is contained within a sealed stainless steel pressure vessel and heated to 160-180° C. Containers suitable for such leaching procedures are commercially available from Bergoff Products & Instruments GmbH, Eningen, Germany. A standard acid solution which has been found to work satisfactorily in leaching to form TSP is made from reagent grade acids and comprises a concentration of approximately 5.3 mol/liter HNO3 and approximately 9.6 mol/liter HF, which is made by ratio of 1:1:1 by volume of HNO3-15.9 mol/liter (nitric acid): HF-28.9 mol/liter (hydrofluoric acid): and water.

Verification of complete leaching may be performed by x-ray radiography to confirm that the acid mixture penetrated the sample and that no macro-scale catalytic metallic regions remain. Subsequently, the sample may be cleaned of residual materials such as nitrates and insoluble oxides by alternating exposure to deionized water in the pressure vessel described above (dilution of the soluble nitrates) and exposing the sample to ultrasonic energy at room temperature (removal of insoluble oxides). It is to be understood that the exact leaching conditions can and will vary on such factors as the leaching agent that is used as well as the materials and sintering characteristics of the diamond body. Additional information about available leaching methods is provided in co-pending U.S. patent application Ser. No. 12/784,460, the contents of which are incorporated herein by reference.

Once the catalyst and filler materials have been removed, the result is TSP. The TSP has a material microstructure characterized by a polycrystalline phase of bonded-together diamond crystals and a plurality of substantially empty voids or pores between the bonded diamond crystals. These voids or pores are substantially empty due to the removal of the catalyst and filler materials during the leaching process described above. Thus, after leaching, the catalyst and filler materials are removed, and the pores are substantially empty. As used herein, the term "removed" is used to refer to the reduced presence of a specific material in the interstitial regions of the diamond layer, for example the reduced presence of the catalyst material used to initially form the diamond body during the sintering or HPHT process, or the filler material, or a metal carbide present in the PCD body (a metal carbide, such as tungsten carbide, may be present through addition to the diamond mixture used to form the PCD body (for example from ball milling the diamond powder) or through infiltration from the substrate used to form the PCD body). It is understood to mean that a substantial portion of the specific material (e.g., catalyst material) no longer resides within the interstitial regions of the PCD body, for example the material is removed such that the voids or pores within the PCD body may be substantially empty. However, it is to be understood that some small amounts of the material may still remain in the microstructure of the PCD body within the interstitial regions and/or remain adhered to the surface of the diamond crystals.

After leaching, the pores may be substantially free of the catalyst material and the filler material. The term "substantially free", as used herein, is understood to mean that a specific material is removed, but that there may still be some small amounts of the specific material remaining within interstitial regions of the PCD body. In an example embodiment, the PCD body may be treated such that more than 98% by weight (% w of the treated region) has had the catalyst material removed from the interstitial regions within the treated region, in particular at least 99% w, more in particular at least 99.5% w may have had the catalyst material removed from the interstitial regions within the treated region. 1-2% w metal may remain, most of which is trapped in regions of diamond regrowth (diamond-to-diamond bonding) and is not necessarily removable by chemical leaching. For example, a trace amount of the filler material may remain in the pores after leaching.

During HPHT sintering, the filler material occupies space between the diamond crystals and creates additional voids or pores when the filler material is removed. In one embodiment, the filler material is provided in a portion of the diamond mixture in order to create a TSP material with a first enhanced porosity portion and a second portion. In one embodiment, after sintering and leaching, the pores occupy about or at least 1% of the volume of the enhanced porosity portion. Applicants have determined that even this low percentage of pores leads to an improvement in infiltration. In another embodiment, the pores occupy about or at least 0.5% of the volume of the enhanced porosity portion. In another embodiment, the enhanced porosity portion (near the substrate) has a porosity that is at least 1.6% greater than the porosity of the second portion of the TSP (near the working surface), as described further below. That is, the differential porosity between the two portions of the TSP is at least 1.6% (for example, the first portion may have a porosity of 9.0% and the second portion 7.4%).

Referring again to FIG. 1, the method then includes re-bonding the TSP material to a substrate 116. In an embodiment, the substrate includes as one of its material constituents a metal solvent that is capable of melting and infiltrating into the TSP material. In one embodiment, the substrate is tungsten carbide with a cobalt binder (WC—Co), and the cobalt acts as the metal solvent infiltrant in the re-bonding process. In other embodiments, other infiltrants such as other metals or metal alloys may be utilized. For example, an added infiltrant in the form of a powder, foil, or film may be provided between the TSP and substrate to infiltrate both the TSP layer and the substrate and facilitate bonding of these two layers. The infiltrant may be a combination of cobalt from the substrate and another added infiltrant. The term "infiltrant" as used herein refers to a material other than the catalyst material used to initially form the PCD material and other than the filler material added to the diamond powder mixture to create an engineered porosity, although it may be the same type of material as either of these. The infiltrant can include materials in Group VIII of the Periodic table. The infiltrant material infiltrates the TSP during re-bonding to bond the TSP to a new substrate.

Bonding the TSP to a substrate includes placing the TSP and a substrate into an HPHT assembly and pressing at high heat and pressure to bond the TSP material to the substrate. The HPHT re-bonding 116 may have different durations, temperatures, and pressures than the HPHT sintering 112. (For example, the temperatures and pressures may be lower during re-bonding than during sintering.) During this final re-bonding step, the infiltrant will infiltrate the leached TSP material, moving into the pores between the diamond crystals (left behind by the filler material) and acting as a glue to bond the TSP layer to the substrate.

Optionally, after re-bonding, the infiltrant can be removed from a portion of the re-bonded TSP material 118 (a process referred to herein as "re-leaching"), as for example from the portion that does the cutting and is exposed to high frictional heat, to improve the thermal stability of that portion of the TSP layer. For example, in one embodiment, substantially all of the infiltrant is removed from the exposed cutting surface 18 (see FIG. 4A) of the TSP layer to a certain depth, but not all the way through the TSP layer to the substrate. Thus, a portion of the infiltrated TSP layer closer to the substrate still retains the infiltrant in the voids between the diamond crystals. The presence of the infiltrant here improves the bonding of the infiltrated TSP layer to the substrate.

Figure 5:
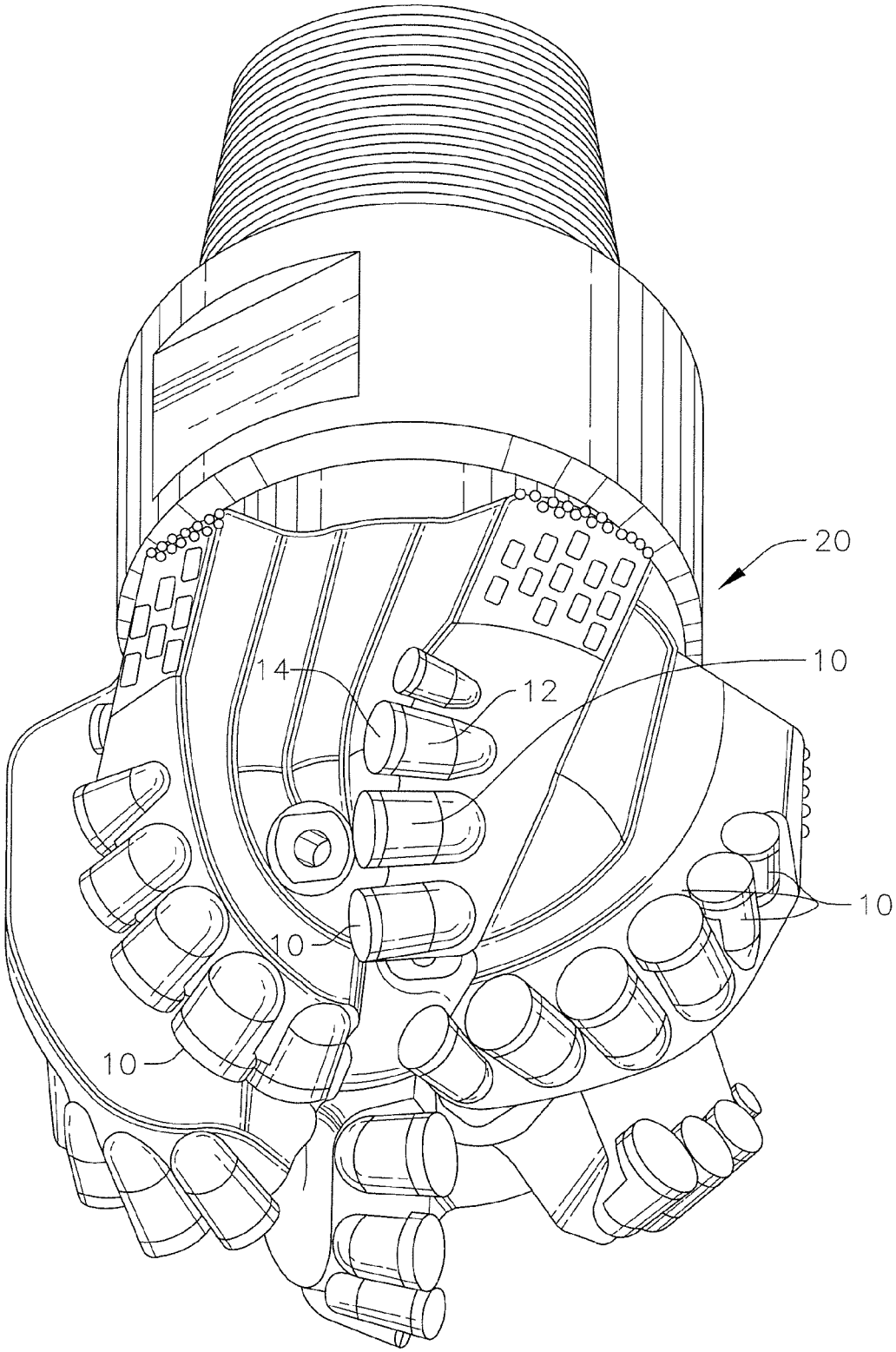
FIG. 5 is a perspective view of a drag bit body including a cutting element according to an embodiment of the present disclosure.

The infiltrated TSP cutting element can then be incorporated into a cutting tool such as a tool for mining, cutting, machining, milling, and construction applications, where properties of thermal stability, wear and abrasion resistance, and reduced thermal stress are desirable. For example, the cutting element of the present disclosure may be incorporated into machine tools and downhole tools and drill and mining bits such as roller cone bits, and drag bits. FIG. 5 shows cutting elements 10 with substrate 12 and re-infiltrated TSP layer 14, incorporated into a drag bit body 20. In one embodiment the cutting elements 10 are shear cutters disposed on a tool body.

Figure 3:
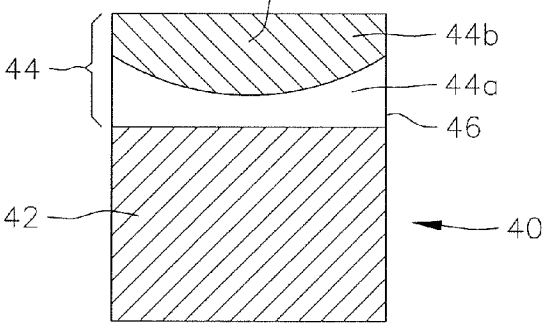
FIG. 3 PRIOR ART
FIG. 3 is a cross-sectional view of a cutting element according to the prior art.

As mentioned above, some prior art TSP cutting elements suffer from premature failure due to incomplete infiltration of the TSP layer during re-bonding, especially in TSP materials with higher diamond densities. The central region of the TSP layer is typically the most difficult to infiltrate. A prior art cutting element 40 is shown in FIG. 3. The cutting element 40 includes a substrate 42 and a TSP body 44. However, the infiltrant material from the substrate has only partially infiltrated the TSP body 44, moving into the region 44*a* nearest the substrate 12. The region 44*b* of the TSP body opposite the substrate is not infiltrated, or is only partially infiltrated, resulting in pores or voids in this region that are empty. As shown in FIG. 3, the infiltrated region 44*a* has a reverse dome or U-shape, with the infiltrant moving further into the TSP body 44 near the outer surface 46 than in the central region 48. This U-shaped infiltration pattern may be explained by wetting effects around the sides of the TSP body 44. As mentioned above, the diamond powder and substrate are placed into a refractory metal enclosure, such as a niobium can, for HPHT sintering. When the can is pressed at high pressure, the refractory metal from the can, such as niobium, interacts with the outer edges and sides of the PCD body. Subsequently, during the re-bonding process, this residual metal around the side surface 46 of the TSP layer creates a wetting effect and assists the infiltrant material moving up from the substrate. Accordingly, the infiltrant follows the niobium (or other can material) and moves in a U-shaped or inverse dome shape through the TSP layer, as shown in FIG. 3.

Additionally, in the prior art, natural metal gradients that form in the PCD layer during HPHT sintering have not been sufficient to enable infiltration during subsequent re-bonding. During the HPHT sintering with a substrate, shrinkage of the diamond powder is affected by the presence of the substrate. The result is PCD with a lower diamond density and higher metal content near the substrate. Prior art PCD cutters have been formed with metal contents after HPHT sintering changing from about 19.8% w near the substrate to about 16.6% w away from the substrate, which creates a small porosity gradient after leaching (such as a porosity differential of less than 1.5%). However, incomplete infiltration after leaching is still observed, especially in TSP with high diamond density. In the embodiments described herein, porosity is increased by adding filler material prior to sintering, which creates a different metal content gradient and pore structure than the natural gradient created by powder shrinkage during HPHT sintering.

The central region 48 of the prior art TSP body 44 may be insufficiently infiltrated during re-bonding. Applicants have discovered that this central region of the TSP layer can be more fully infiltrated by providing larger and/or more pores in this region of the TSP layer. Increasing the porosity of the TSP layer leads to better infiltration, as it provides more pores through which the infiltrant can move. The infiltrant moves more easily into TSP with a larger pore size.

Figure 4A:
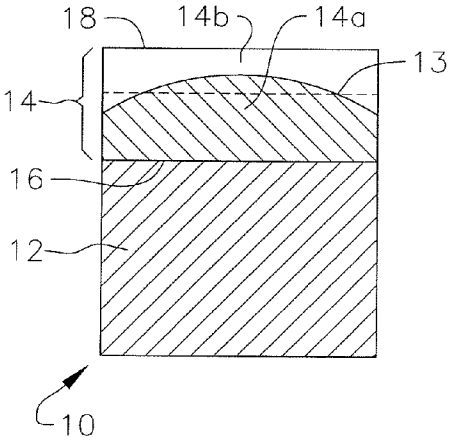
FIG. 4A is a cross-sectional view of a cutting element according to an exemplary embodiment of the present disclosure.

Accordingly, in an exemplary embodiment of the disclosure, filler material is added to the diamond powder mixture prior to HPHT sintering in order to increase the pore size and/or increase the number of pores in the TSP layer nearest the substrate, in accordance with the method described above. A cutting element 10 according to an embodiment is shown in FIG. 4A. The cutting element 10 includes a substrate 12 bonded to a TSP body 14 at an interface 16. The TSP body 14 includes a first region or layer 14*a* near the substrate with a larger porosity than a second region or layer 14*b* opposite the substrate (proximate the working surface 18). In this embodiment, the interface 15 between the two layers 14*a*, 14*b* is domed, with the enhanced porosity layer 14*a* extending further into the TSP body 14 in the center of the TSP body 14 than at the outer surface. That is, the enhanced porosity layer 14*a* is closer to the working surface 18 of the TSP layer at the center than at the outer surfaces. This geometry counteracts the reverse-dome infiltration seen in prior art cutting elements, shown in FIG. 3. As mentioned above, the infiltrant tends to move into the prior art TSP layer in a reverse-dome shape, assisted by the residual can material on the outer surface 46. The domed shape of the first layer 14*a* of increased porosity (shown in FIG. 4A) facilitates movement of the infiltrant into the center of the TSP layer, where it is typically most difficult to infiltrate. Thus, it is believed that the movement of the infiltrant into the TSP layer may follow a path such as the dotted line 13 in FIG. 4A; that is, it may move into the TSP body with a less pronounced inverse dome due to the increased porosity in the first layer 14*a*.

The domed shape of the first layer 14*a* in the TSP body 14 can be formed by creating a depression in the diamond powder mixture prior to HPHT sintering. The diamond powder that forms the second layer 14*b* is depressed in the center into a bowl or reverse dome shape. Then, the diamond powder with filler material, which will form the first layer 14*a*, is deposited over the depressed/bowl diamond layer and fills the depression. The diamond powder forming the second layer 14*b* has no filler material, or less filler material than the powder forming the first layer 14*a*. A substrate is placed on top of this diamond and filler mixture (i.e., the first layer 14*a*), and the materials are then HPHT sintered. The result is a PCD layer with a domed portion having the extra filler material between the bonded diamond crystals. When this filler material is removed, leaving pores behind, the result is a TSP material with a domed first layer 14*a* of enhanced porosity.

Figure 4B:
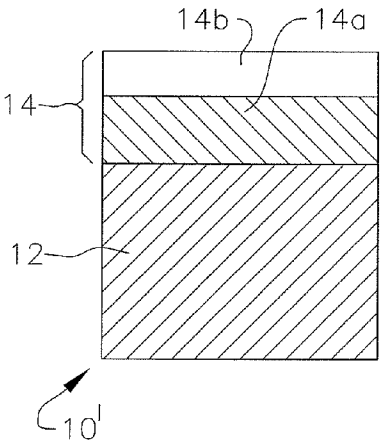
FIG. 4B is a cross-sectional view of a cutting element according to an exemplary embodiment of the present disclosure.

In other embodiments, the first layer with enhanced porosity has other shapes. In FIG. 4B, a cutting element 10' includes a TSP body 14 with a first layer 14*a* with enhanced porosity and an overlying second layer 14*b* without this increased porosity. The interface 15 between these two layers in FIG. 4B is planar or flat. In one embodiment the first layer 14*a* is smaller than the second layer 14*b*, and in another embodiment it is larger, and in another embodiment the two layers are the same size, each occupying one half of the TSP body 14.

Figure 4C:
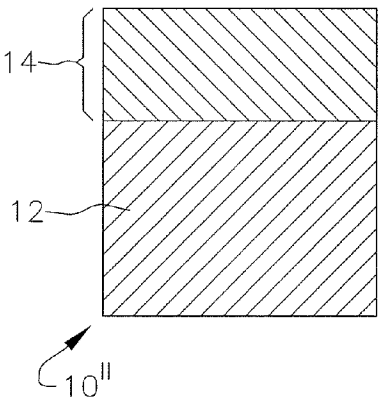
FIG. 4C is a cross-sectional view of a cutting element according to an exemplary embodiment of the present disclosure.

In FIG. 4C, a cutting element 10" includes a TSP body 14 with enhanced porosity throughout, rather than two separate layers, one with enhanced porosity.

In other embodiments, the enhanced porosity layer 14*a* extends up into the central region of the TSP layer but is not necessarily a dome shape as shown in FIG. 4A. Other three-dimensional geometries can be used to create additional pores in the central region of the TSP body, in order to assist infiltration. In one embodiment, the enhanced porosity layer 14*a* is at least 25% of the volume of the TSP body 14. In another embodiment the layer 14*a* is about 50% of the volume of the TSP body 14, and the layer 14*b* is about 50%. Within the layer 14*a* itself, in one embodiment the pores occupy about 1% of the volume of this portion.

In each of the embodiments shown in FIGS. 4A-4C, the TSP body with the enhanced porosity layer is re-bonded to a substrate as described above, and then optionally re-leached and incorporated into a cutting tool.

The portion with enhanced porosity may be a discrete portion of the TSP body, with a step-wise interface to an adjacent portion with a lower porosity. Two, three, or more portions with different porosities may be included in the TSP body, with each portion further from the substrate having a lower porosity. These portions may be layers that are formed by stacking two or more diamond powder layers formed from diamond powder mixtures that have less filler material, or a different filler material, further from the substrate, and then HPHT sintering as described above. In arranging these stacked layers, the porosity of the TSP body and thus its infiltration characteristics can be controlled. Alternatively, the porosity may decrease as a gradient through the TSP body. Prior to HPHT sintering, the diamond powder and filler material mixture can be arranged with decreasing filler material particle size, or with decreasing amounts of filler particles, in order to create a decreasing porosity gradient. Thus, by varying the size, amount, and type of filler material, a porosity gradient or porosity layers can be formed in the TSP body.

The filler material or additive that is added to the diamond powder mixture to increase the porosity of the resulting TSP layer can be cobalt, tungsten carbide, silicone carbide, metals not in Group VIII of the Periodic Table, any other solvent metal catalyst such as nickel or iron or alloys of these, or any other carbide or metal that is removable, as for example by a leaching process. The filler should be digestible by some type of acid mixture or chemical or thermal treatment to remove the filler from the sintered PCD body. The filler can be a mixture of these materials as well. In one embodiment, to control the porosity, the filler near the substrate is cobalt and the particles of cobalt added to the diamond powder mixture are approximately 1.5 to 2 microns in size. In another exemplary embodiment, the filler is tungsten carbide and the particles of tungsten carbide are approximately 0.6 micron. In an exemplary embodiment, the portion of the diamond powder with the filler material includes at least 5% filler material by weight. In another embodiment, this portion of the diamond powder includes at least 10% filler material by weight, and in another embodiment at least 15%. For example, when tungsten carbide is used as the filler material, the diamond powder can include 5%, 10%, or 15% tungsten carbide by weight, or any percentage within this range of 5-15%. The size of the particles of the filler material can be chosen to control the resulting pore structure after sintering and leaching. Fine particles of filler material can be added to create a distribution of fine, dispersed pores. Larger particles of filler material can be added to create larger, less dispersed pores.

In another embodiment, the filler material is cobalt, and the cobalt acts as both a catalyst material and a filler. That is, cobalt particles can be added to the diamond powder mixture as both a catalyst material to promote intercrystalline diamond bonding, and as a filler material to create the desired porosity. Before leaching this cobalt (or other catalyst material) from the sintered PCD, the PCD layer includes at least 4% cobalt by weight, or in another embodiment about 4-10% cobalt by weight.

In other embodiments, the filler material is a different material from the catalyst material. For example, the filler material may be tungsten carbide, and the catalyst material may be cobalt, with the weight percentages of tungsten carbide as given above. Both the tungsten carbide filler and the cobalt catalyst can be mixed into the diamond powder mixture prior to sintering. In one embodiment, the portion of the diamond powder mixture with the tungsten carbide filler includes 5% by weight tungsten carbide particles. In some applications, it may be desirable to use a filler material that is different than the catalyst material, as a large amount of added catalyst material can decrease the diamond density and wear resistance of the resulting sintered cutter. A filler that is different from the catalyst material can be utilized in order to increase the porosity in the TSP body while maintaining the desired amount of catalyst material.

A comparison of the TSP infiltration yield of prior art TSP cutting elements and embodiments of the present disclosure shows an improvement in infiltration. The data provided below was obtained by HPHT sintering diamond powders at various pressures, as shown. For each pressure, at least 200 monolayer cutting elements were sintered. The TSP infiltration yield was found by determining the percentage of these sintered cutting elements that had the infiltrant material present at the top surface of the TSP body after re-bonding. The average particle size of the diamond grains in these tests was 12 micron, with 2% cobalt added. The TSP infiltration yield for cutting elements without any filler material (monolayer TSP bodies) was found to be as follows:

TABLE I

| HPHT Sintering Pressure | Cold Cell Pressure | TSP Infiltration (Yield) |
|---|---|---|
| 9,200 psi | 4.9 GPa | Near 100% |
| 10,000 psi | 5.2 GPa | 70-80% |
| 10,785 psi | 5.4 GPa | Below 70% |

The sintering pressures above are hydraulic fluid pressures during HPHT sintering. As the sintering pressure is increased, the diamond crystals are forced closer together in the sintering stage, creating a smaller pore structure (lower porosity). When this sintered material is processed into TSP and re-bonded, it is more difficult to infiltrate the material with this smaller pore structure. Thus, the yield above decreases with higher HPHT sintering pressure.

To test for improvement with embodiments of the inventive process, a two layer TSP material construction was formed in which the upper half (2nd layer) of the TSP layer was the same as in the previous example, and the bottom half (1st layer) of the TSP layer contained a filler material of either Co or WC, as shown below. Equal volumes of each material (the first and second layers) were used to manufacture the TSP. The TSP infiltration yield for cutting elements including the filler materials shown below was found to be as follows (with the first row below showing the mono-layer TSP for comparison):

TABLE II

| Mixture | Sintering Pressure | 2nd Layer Composition | 1st Layer Composition | Differential Vol % Porosity | Reinfiltration Yield (samples tested) |
|---|---|---|---|---|---|
| 1 | 10785 psi | 98 wt % Dia<br>2 wt % Co | 98 wt % Dia<br>2 wt % Co | 0 vol % | <70%<br>(>100 samples) |
| 2 | 10785 psi | 98 wt % Dia<br>2 wt % Co | 96 wt % Dia<br>4 wt % Co | 1.0 vol % | 83%<br>(10/12) |
| 3 | 10785 psi | 98 wt % Dia<br>2 wt % Co | 93 wt % Dia<br>7 wt % Co | 2.6 vol % | 100%<br>(12/12) |
| 4 | 10785 psi | 98 wt % Dia<br>2 wt % Co | 90 wt % Dia<br>10 wt % Co | 4.2 vol % | 100%<br>(12/12) |
| 5 | 10785 psi | 98 wt % Dia<br>2 wt % Co | 97 wt % Dia<br>5 wt % WC<br>2 wt % Co | 1.6 vol % | 100%<br>(20/20) |
| 6 | 10785 psi | 98 wt % Dia<br>2 wt % Co | 88 wt % Dia<br>10 wt % WC<br>2 wt % Co | 3.4 vol % | 100%<br>(12/12) |

The diamond mixture used in this study was a uniform blend of 50% 12-22 micron, 38% 6-12 micron, and 12% 2-4 micron cuts. Mixtures 2-4 above used an additional amount of the catalyst material, cobalt, as the filler material. Mixtures 5 and 6 used tungsten cobalt as the filler material. The sintering pressure of 10785 psi corresponds to a cold cell pressure of about 5.4 GPa.

Table II above shows that the filler material improved the infiltration yield compared to a monolayer TSP body without the filler material. Table II also shows the differential porosity between the two layers in the TSP body. Mixture 1 had a zero differential porosity, as it was a monolayer construction. The remaining Mixtures 2-6 included different first and second layers, and resulted in a non-zero differential porosity between the first and second layers, with the first layer (proximate the substrate) having an enhanced porosity compared to the second layer. The differential porosity is the difference in porosity between these two layers. The porosities of the two layers can be measured by the apparent porosity method, described below, after leaching and prior to infiltration during re-bonding.

As shown in Table II, each mixture that included a filler material showed an improvement in yield over Mixture 1. An increased yield was achieved with Mixture 2 by increasing the amount of cobalt in the first layer from 2% to 4%. However this additional amount of filler material in Mixture 2 did not result in 100% yield. Mixture 5, with 5% added tungsten carbide as the filler, had the smallest differential porosity (1.6%) that resulted in 100% yield. Thus, in one embodiment, a TSP body includes a first layer and a second layer, with the difference in porosity between the two layers being at least 1.6%, such as at least or about 2.6%, at least or about 3.4%, or at least or about 4.2% (with the porosity of the first layer greater than the second layer).

In another embodiment, a method of increasing the porosity of the TSP layer near the substrate includes the use of designed diamond particle size distributions. Prior to HPHT sintering, the diamond crystals can be arranged to have greater porosity in the region that will be adjacent the substrate during re-bonding. For example, the diamond powder mixture can include a region that is less dense such as by omitting the finer diamond grains that pack into and fill the spaces between larger diamond grains. After HPHT sintering, this region will include larger pores between bonded diamond crystals than the more densely packed diamond regions. This technique can be used in combination with filler material to control the porosity of the TSP layer.

By increasing the porosity of the TSP material near the interface with the substrate and in the center of the TSP layer, more complete infiltration of the infiltrant material into the TSP layer is achieved during re-bonding. As a result, the TSP layer is more fully infiltrated, leading to a better bond between the TSP layer and the substrate and a more uniform TSP layer with reduced thermal stresses and structural flaws.

The porosity of the leached TSP layer can be characterized by such techniques as image analysis or mercury porosimetry. One method for measuring the porosity of a TSP body or a region or portion of the TSP body (referred to as the TSP sample) is the "Apparent Porosity" method. The apparent porosity of a sample is the percentage by volume of voids over the total volume of the sample. The apparent porosity method measures the volume of voids in the sample. This method includes obtaining a TSP sample (which has been leached to remove the catalyst and filler materials in the pores between the diamond crystals), measuring the weight of the TSP sample, and then immersing it in water and weighing again to determine the increased weight from the permeation of water into the pores. Based on the increase in weight from the water, the volume of the pores can be determined.

The apparent porosity method is performed according to the ASTM (American Society for Testing and Materials) C20 standard for determining apparent porosity of a sample. Specifically, after leaching and cleanup, the prepared TSP sample is weighed to determine the leached weight (WL). Next, the sample is submerged in boiling water for at least two hours to infiltrate water into the leached interstitial regions (pores) of the TSP sample. After cooling, the infiltrated, submerged sample is weighed in water to determine the leached, infiltrated, submerged weight (WLIS). The sample is then gripped with a paper towel and removed from the water. Water remains trapped in the internal pores of the sample. The sample is then weighed to determine the leached and infiltrated weight in air (WLI).

With these values, the apparent porosity (AP) of the sample can be determined with the following equation:

$$AP = \frac{(WLI - WL)}{(WLI - WLIS)} \quad (1)$$

That is, the apparent porosity AP is the increase in weight of the leached sample after boiling water infiltration (WLI–WL) divided by the difference in weight of the leached and infiltrated sample after being submerged. This value shows the percentage by volume of empty pores in the TSP sample.

The apparent porosity measures interconnected porosity—the increase in weight due to water infiltration into the interconnected leached pores. However, some pores are isolated and not reached by the water, or are too small or interconnected by channels that are too fine to permit entry of the water. Other pores may remain partially occupied by metal and thus will not be fully infiltrated by the water. These various un-infiltrated pores are not included in the above calculation of apparent porosity. The above method can be used to calculate the interconnected porosity of various TSP samples, and compare the porosity of different TSP layers. Thus the apparent porosity method can be used to measure the interconnected porosity of the first layer of the TSP body, and the method can also be used to measure the interconnected porosity of the second layer of the TSP body, so that the differential porosity can be determined.

In one embodiment the method disclosed herein for providing increased porosity is used with diamond mixtures having an average grain size of 12 micron or smaller. Diamond mixtures that include fine grains in the mixture tend to have smaller pore structures after sintering, and thus the addition of the filler material prior to sintering is useful to increase the porosity in the region near the substrate. In one embodiment, the method disclosed herein for providing increased porosity is used with diamond mixtures that are HPHT sintered at pressures above 5.2 GPa (cold cell pressure). These high pressures compact the diamond mixture, resulting in a small pore structure absent the addition of a filler material.

Relative sizes are exaggerated in FIGS. 2-4 for clarity, and are not necessarily to scale.

Although the present invention has been described and illustrated in respect to exemplary embodiments, it is to be understood that it is not to be so limited, since changes and modifications may be made therein which are within the full intended scope of this invention as hereinafter claimed. For example, the infiltrants identified herein for infiltrating the TSP material have been identified by way of example. Other infiltrants may also be used to infiltrate the TSP material and include any metals and metal alloys such as Group VIII and Group IB metals and metal alloys. Moreover, it should be understood that the TSP material may be attached to other carbide substrates besides tungsten carbide substrates, such as substrates made of carbides of W, Ti, Mo, Nb, V, Hf, Ta, and Cr.

What is claimed is:

1. A cutting element comprising:

a substrate; and a preformed thermally stable polycrystalline diamond body bonded to the substrate with at least an infiltrant, wherein the thermally stable polycrystalline diamond body comprises:

a working surface opposite the substrate;

a material microstructure comprising a plurality of bonded-together diamond crystals, and pores between the diamond crystals, the pores being substantially free of a catalyst material;

a first portion of the material microstructure proximate the substrate and having a porosity; and a second portion of the material microstructure adjacent said first portion along an interface and extending to at least proximate the working surface and having a porosity, wherein the first portion occupies at least 25% of a volume of the polycrystalline diamond body, wherein the first portion comprises said infiltrant material in one or more of the pores between the diamond crystals previously occupied by a catalyst and a filler, said filler being different from said catalyst, and wherein the material microstructure has a differential porosity of at least 1.6% between the first and second portions when said porosities are measured without said infiltrant.

2. The cutting element of claim 1, wherein the first portion comprises a first layer of the polycrystalline diamond body and the second portion comprises a second layer of the polycrystalline diamond body, and wherein the first and second layers meet along said interface.

3. The cutting element of claim 2, wherein the interface is domed.

4. The cutting element of claim 3 wherein thermally stable polycrystalline diamond body comprises a peripheral surface extending from the substrate to the working surface, wherein an edge is defined at an intersection of the peripheral surface and the working surface.

5. The cutting element of claim 4 wherein the working surface is flat.

6. The cutting element of claim 2, wherein the interface is planar.

7. The cutting element as recited in claim 2, wherein the second layer comprises a depression and wherein the first layer comprises a projection received within said depression.

8. The cutting element of claim 7, wherein the depression is complementary to said projection.

9. The cutting element of claim 7, wherein the projection is domed shaped.

10. A downhole tool comprising a tool body and at least one cutting element as claimed in claim 7 disposed thereon.

11. The downhole tool of claim 10, wherein the downhole tool comprises a drill bit.

12. The cutting element of claim 1, wherein the differential porosity is at least 2.6%.

13. The cutting element of claim 1, wherein the differential porosity is at least 3.4%.

14. The cutting element of claim 1, wherein one or more pores in the first portion comprise a trace amount of the filler material, the filler material being selected from the group consisting of tungsten carbide, silicone carbide, and metals not in Group VIII of the Periodic Table.

15. The cutting element of claim 14, wherein the filler material is tungsten carbide.

16. The cutting element of claim 1, wherein the second portion comprises the infiltrant material in one or more of the pores between the diamond crystals.

17. The cutting element of claim 16, wherein the working surface comprises the infiltrant material in one or more of the pores between the diamond crystals.

18. The cutting element of claim 1, wherein the first portion comprises a first layer and the second portion comprises a second layer, and wherein the first and second layers are each approximately 50% of the volume of the polycrystalline diamond body.

19. A downhole tool comprising a tool body and at least one cutting element as claimed in claim 1 disposed thereon.

20. The downhole tool of claim 19, wherein the downhole tool comprises a drill bit.

21. The cutting element of claim 1 wherein the porosity of the first portion is greater than the porosity of the second portion, wherein the porosity of the material microstructure is decreased by at least 1.6% across the interface from the first to the second portion.

22. The cutting element of claim 1, wherein the diamond crystals of said first portion have a first average grain size and wherein the diamond crystals of second portion have a second average grain size that is the same and the first average grain size.

23. The cutting element as recited in claim 1, wherein the diamond crystals of said first portion have a first grain size distribution and wherein the diamond crystals of second portion have a second grain size distribution that is the same and the first grain size distribution.

24. A cutting element comprising:

a substrate; and a preformed thermally stable polycrystalline diamond body bonded to the substrate with at least an infiltrant, wherein the thermally stable polycrystalline diamond body comprises:

a working surface opposite the substrate;

a peripheral surface extending from the substrate to the working surface, wherein an edge is defined at an intersection of the peripheral surface and the working surface;

a material microstructure comprising a plurality of bonded-together diamond crystals, and pores between the diamond crystals, the pores being substantially free of a catalyst material;

a first portion of the material microstructure proximate the substrate having a porosity and comprising a projection; and a second portion of the material microstructure extending to at least proximate the working surface having a porosity and comprising a depression receiving said projection, wherein the first portion comprises said infiltrant material in one or more of the pores between the diamond crystals previously occupied by a catalyst and a filler, said filler being different from said catalyst, and wherein the material microstructure has a differential porosity between the first and second portions when said porosities are measured without said infiltrant.

25. The cutting element of claim 24 wherein the porosity of the first portion is greater than the porosity of the second portion, wherein the porosity of the material microstructure is decreased by at least 1.6% across the interface from the first to the second portion.

26. A downhole tool comprising a tool body and at least one cutting element as claimed in claim 24 disposed thereon.

27. The downhole tool of claim 26, wherein the downhole tool comprises a drill bit.

28. The cutting element of claim 24, wherein the diamond crystals of said first portion have a first average grain size and wherein the diamond crystals of second portion have a second average grain size that is the same and the first average grain size.

29. The cutting element as recited in claim 24, wherein the diamond crystals of said first portion have a first grain size distribution and wherein the diamond crystals of second portion have a second grain size distribution that is the same and the first grain size distribution.

30. A cutting element comprising:

a substrate; and a preformed thermally stable polycrystalline diamond body bonded to the substrate with at least an infiltrant, wherein the thermally stable polycrystalline diamond body comprises:

a working surface opposite the substrate;

a material microstructure comprising a plurality of bonded-together diamond crystals, and pores between the diamond crystals, the pores being substantially free of a catalyst material;

a first portion of the material microstructure proximate the substrate and having a porosity; and a second portion of the material microstructure adjacent said first portion along an interface and extending to at least proximate the working surface and having a porosity, wherein the first portion occupies at least 25% of a volume of the polycrystalline diamond body, wherein the first portion comprises said infiltrant material in one or more of the pores between the diamond crystals previously occupied by a catalyst and a filler, said filler being different from said catalyst, wherein the diamond crystals of said first portion have a first average grain size and the diamond crystals of the second portion have a second average grain size that is the same as the first average grain size, and wherein the material microstructure has a differential porosity of at least 1.6% between the first and second portions when said porosities are measured without said infiltrant.

31. The cutting element of claim 30, wherein the first portion comprises a first layer of the polycrystalline diamond body and the second portion comprises a second layer of the polycrystalline diamond body, and wherein the first and second layers meet along said interface.

32. The cutting element of claim 30, wherein the interface is domed.

33. The cutting element of claim 30, wherein the interface is planar.

34. The cutting element as recited in claim 30, wherein the second layer comprises a depression and wherein the first layer comprises a projection received within said depression.

* * * * *

UNITED STATES PATENT AND TRADEMARK OFFICE

CERTIFICATE OF CORRECTION

PATENT NO. : 8,783,389 B2
APPLICATION NO. : 12/818780
DATED : July 22, 2014
INVENTOR(S) : Guojiang Fan et al.

It is certified that error appears in the above-identified patent and that said Letters Patent is hereby corrected as shown below:

Claims

| | |
|---|---|
| Col. 15, line 18, Claim 9 | Delete "domed", |
| | Insert --dome-- |
| Col. 15, line 57, Claim 22 | Delete "same and the", |
| | Insert --same as the-- |
| Col. 15, lines 62-63, Claim 23 | Delete "same and the", |
| | Insert --same as the-- |
| Col. 16, line 38, Claim 28 | Delete "same and the", |
| | Insert --same as the-- |
| Col. 16, lines 43-44, Claim 29 | Delete "same and the", |
| | Insert --same as the-- |

Signed and Sealed this
Fifth Day of July, 2016

Michelle K. Lee

Michelle K. Lee
*Director of the United States Patent and Trademark Office*